US006422485B1

(12) United States Patent
Hsu

(10) Patent No.: US 6,422,485 B1
(45) Date of Patent: Jul. 23, 2002

(54) PISTOL NOZZLE

(76) Inventor: Chao-Te Hsu, No. 63-4, Ting-Tsuo Lane Ting Tsuo Li, Lu Kang Township, Chang Hua Hsien (TW)

( * ) Notice: Subject to any disclaimer, the term of this patent is extended or adjusted under 35 U.S.C. 154(b) by 0 days.

(21) Appl. No.: 09/728,906

(22) Filed: Dec. 4, 2000

(51) Int. Cl.[7] ..... B05B 7/02
(52) U.S. Cl. ..... 239/526; 239/532
(58) Field of Search ..... 239/530, 532, 239/525, 526, 281

(56) References Cited

U.S. PATENT DOCUMENTS 3,727,841 A * 4/1973 Hengesbach ..... 239/532
6,158,677 A * 12/2000 Coles ..... 239/526
6,220,527 B1 * 4/2001 Chen et al. ..... 239/532

* cited by examiner

*Primary Examiner*—Lisa A. Douglas
(74) *Attorney, Agent, or Firm*—Harrison & Egbert

(57) ABSTRACT

A pistol nozzle is designed to emit a compressed fluid and is formed of a main body and a telescopic barrel set. The main body is provided with a trigger, a retaining hook, a fluid emitting end, and a fluid admission end which is fastened to a fluid pipe. The telescopic barrel set is fastened to the fluid emitting end of the main body and is formed of a fastening mount, a plurality of telescopic tubes, a plurality of stop members, and a plurality of washers. The fastening mount is fastened at one end to the fluid emitting end of the main body and is provided at the opposite end to a stepped and threaded portion. The telescopic tubes are fastened at the base end thereof to the stepped and threaded portion of the fastening mount at such time when they are collapsed together. The telescopic tubes are extended in conjunction with the stop members and the washers.

2 Claims, 9 Drawing Sheets

PISTOL NOZZLE

BACKGROUND OF THE INVENTION

1. Field of the Invention

The present invention relates generally to a pistol nozzle, and more particularly to a pistol nozzle having a telescopic barrel, through which a compressed fluid is emitted.

2. Description of Related Art

As shown in FIGS. 1 and 2, a pistol nozzle of the prior art has a main body 10 which is provided with a trigger 101, and a handle 102 connected with a fluid pipe. The main body 10 is fastened at the front end to a telescopic barrel 11, through which the fluid is emitted. The telescopic barrel 11 has a plurality of sections that slide into each other. The telescopic barrel 11 of the prior art pistol nozzle is defective in design because its outermost section is apt to be forced out by the compressed fluid at the time when the telescopic barrel 11 is at work in the collapsed state. As a result, the outermost section of the telescopic barrel 11 in action may come in contact with a foreign object, thereby resulting in contamination of the telescopic barrel 11 by the foreign object.

BRIEF SUMMARY OF THE INVENTION

The primary objective of the present invention is to provide a pistol nozzle with a telescopic barrel free of the drawback of the prior art pistol nozzle described above.

In keeping with the principle of the present invention, the foregoing objective of the present invention is attained by a pistol nozzle comprising a main body, a telescopic barrel having a plurality of sections, and a locating member for preventing the telescopic barrel from being displaced by the force of the compressed fluid flowing through the telescopic barrel.

The features, functions, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
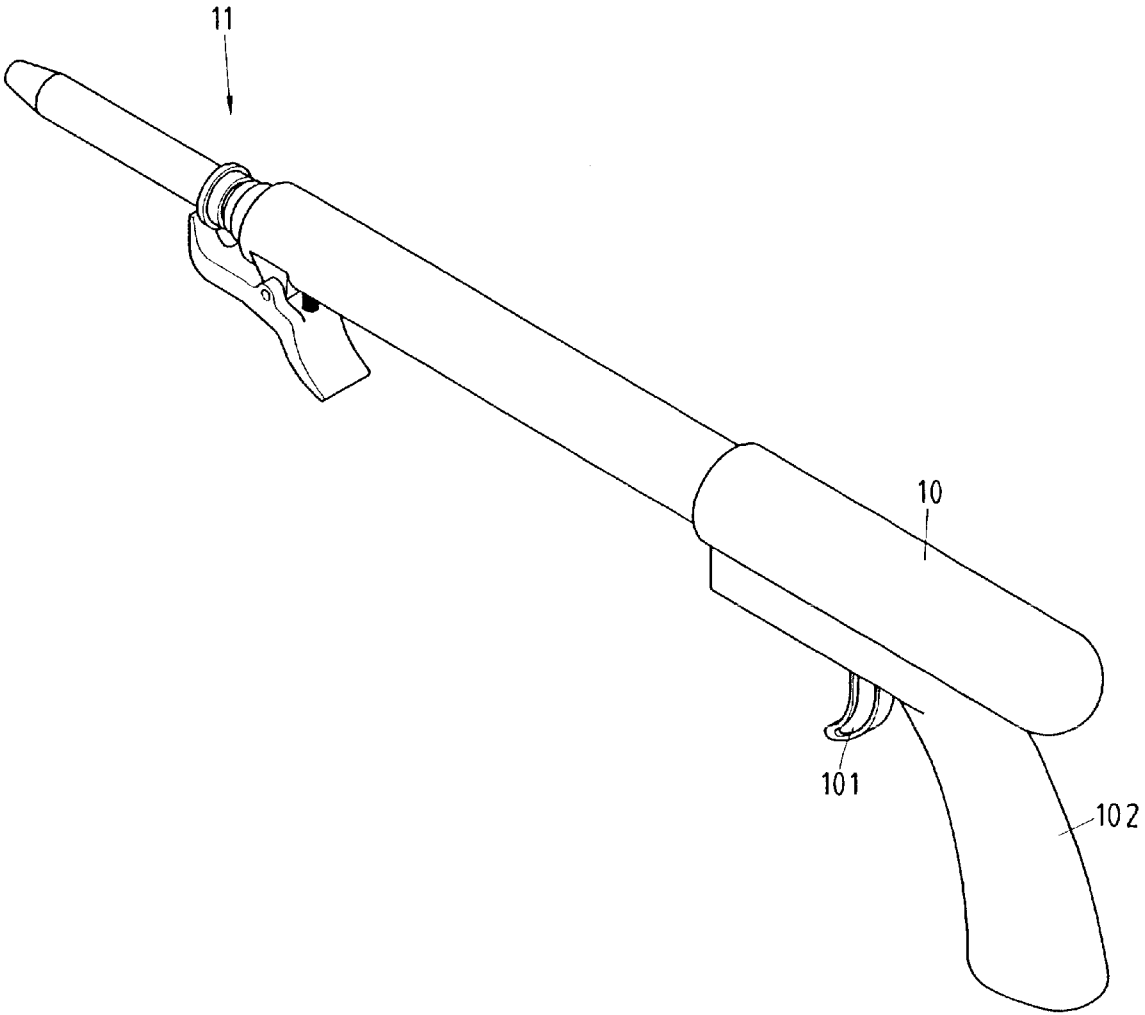
FIG. 1 PRIOR ART
FIG. 1 shows a perspective view of a pistol nozzle of the prior art.
Figure 2:
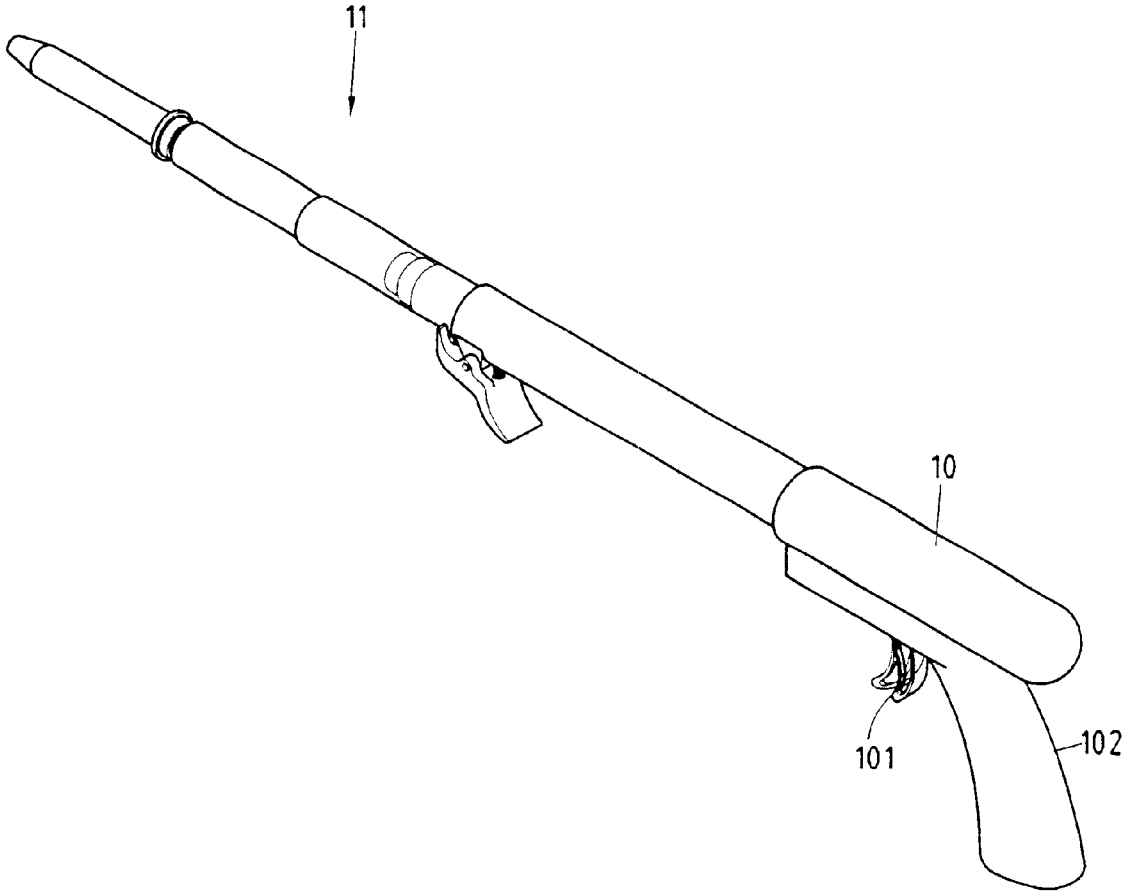
FIG. 2 PRIOR ART
FIG. 2 shows a schematic view of the prior art pistol nozzle in use.
Figure 3:
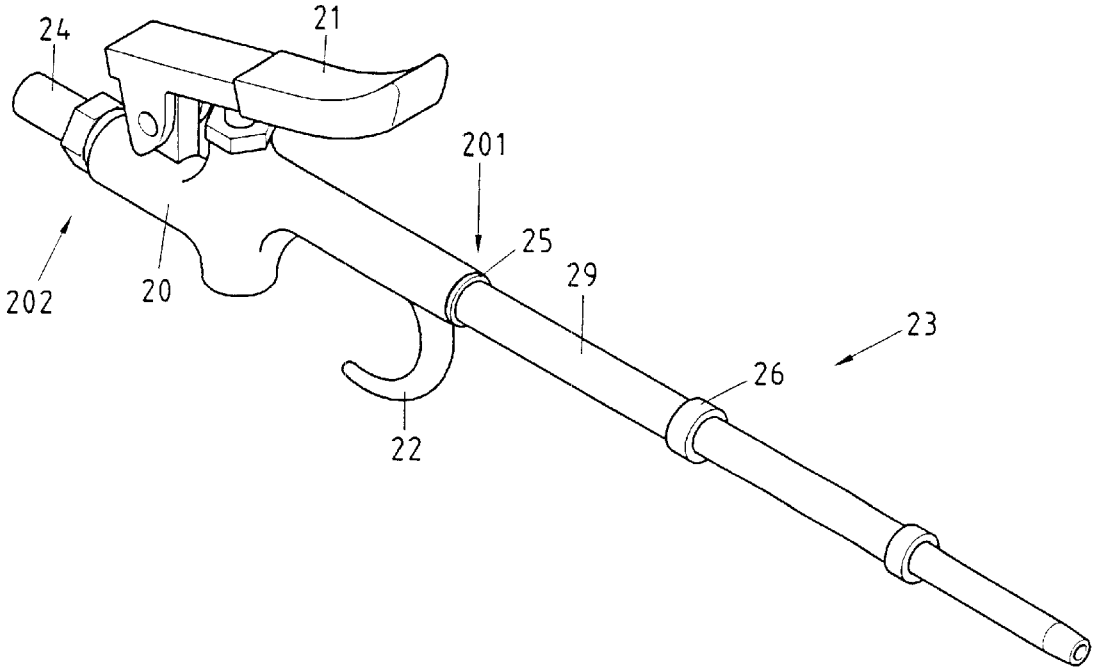
FIG. 3 shows a perspective view of the preferred embodiment of the present invention.
Figure 4:
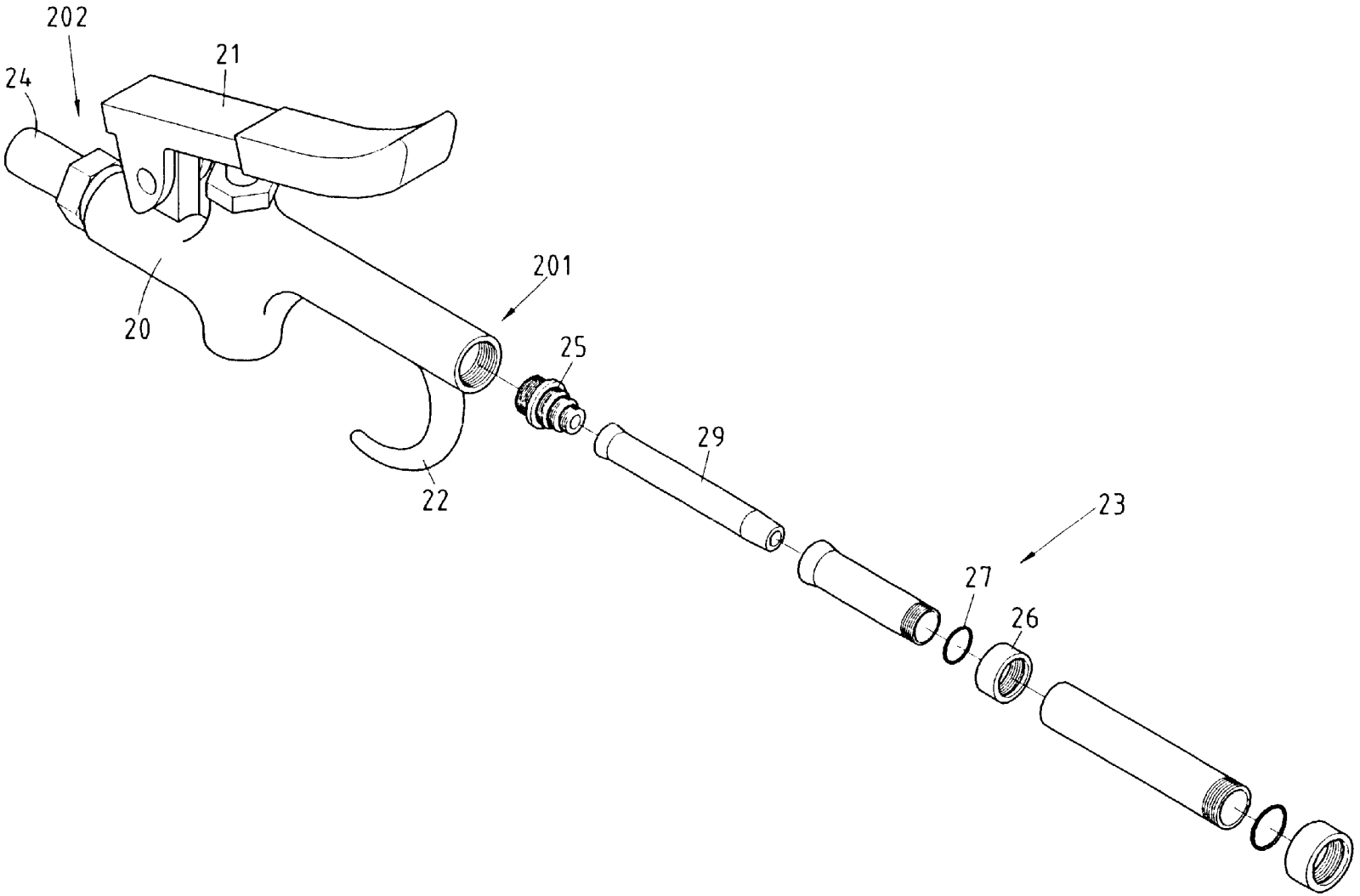
FIG. 4 shows an exploded perspective of the preferred embodiment of the present invention.
Figure 5:
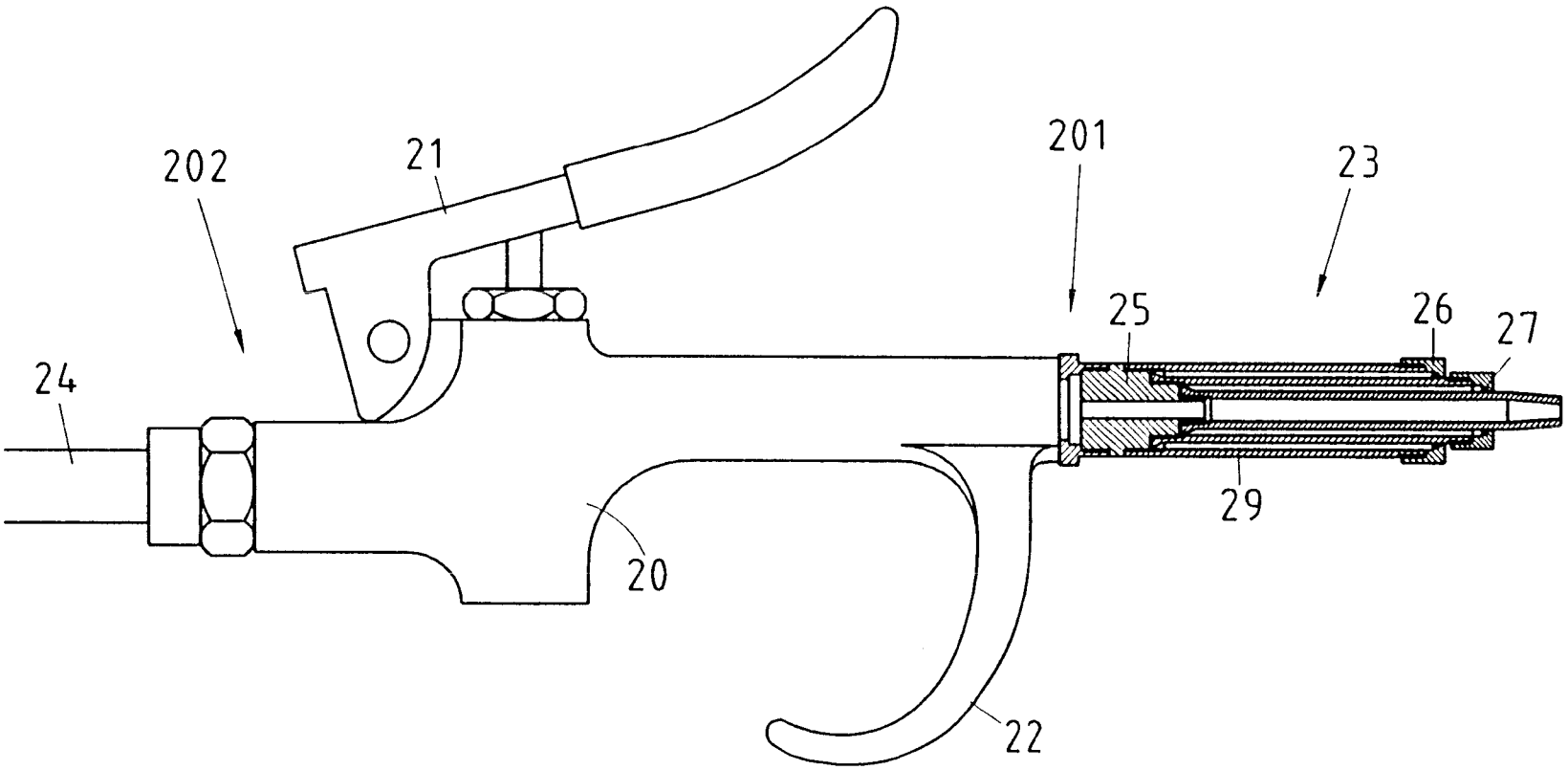
FIGS. 5–8 are schematic views of the preferred embodiment of the present invention in use.
Figure 6:
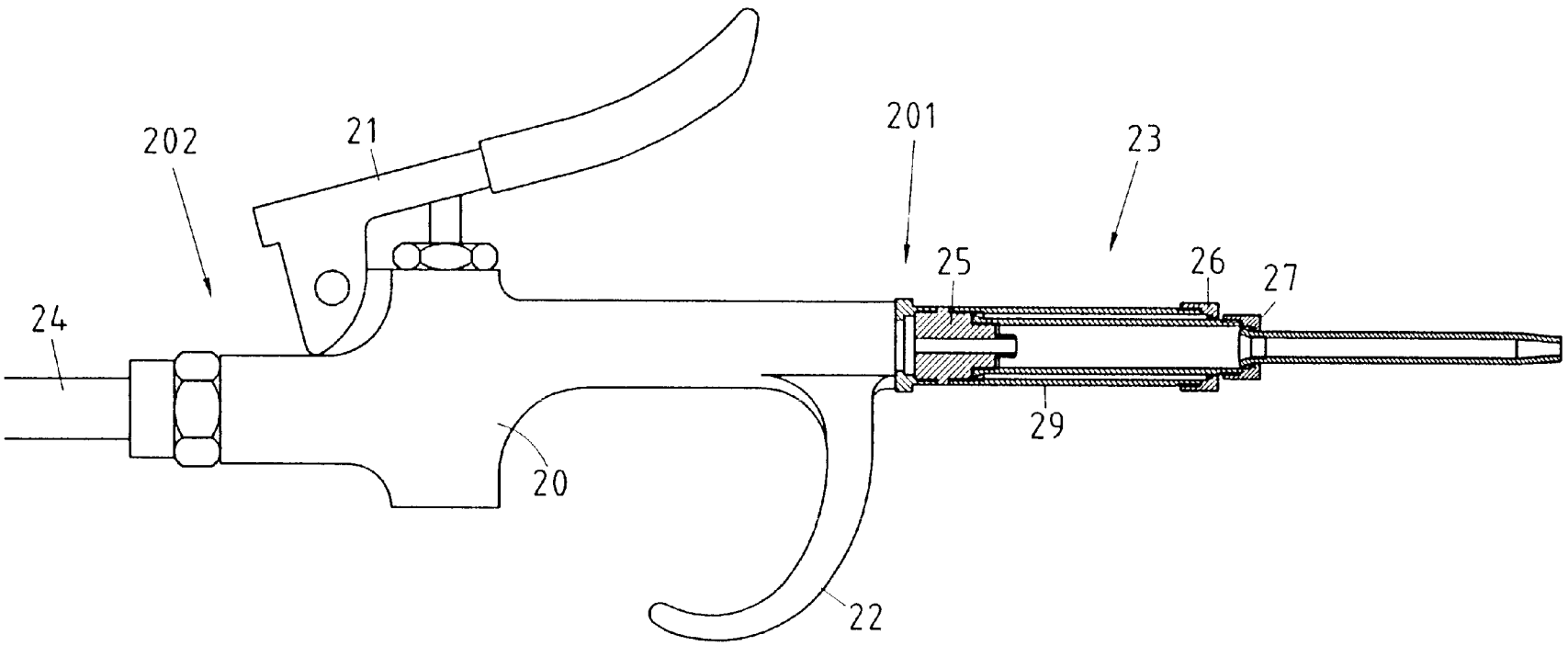
Figure 7:
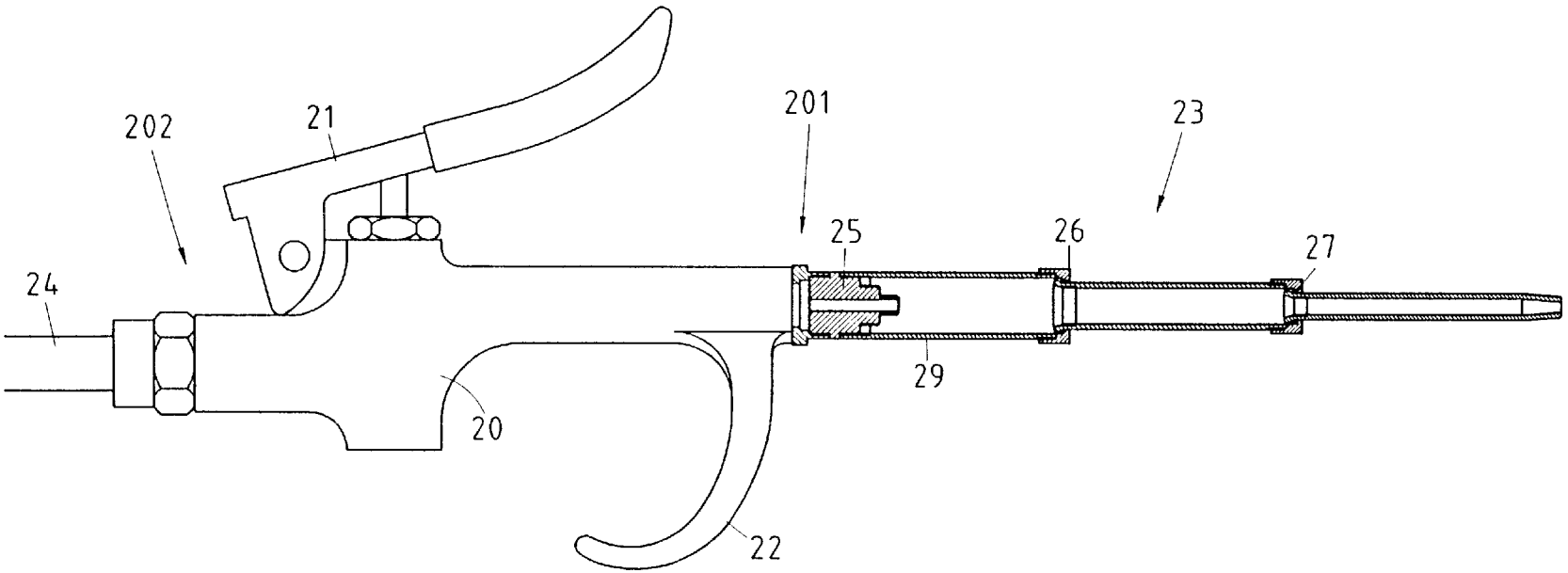
Figure 8:
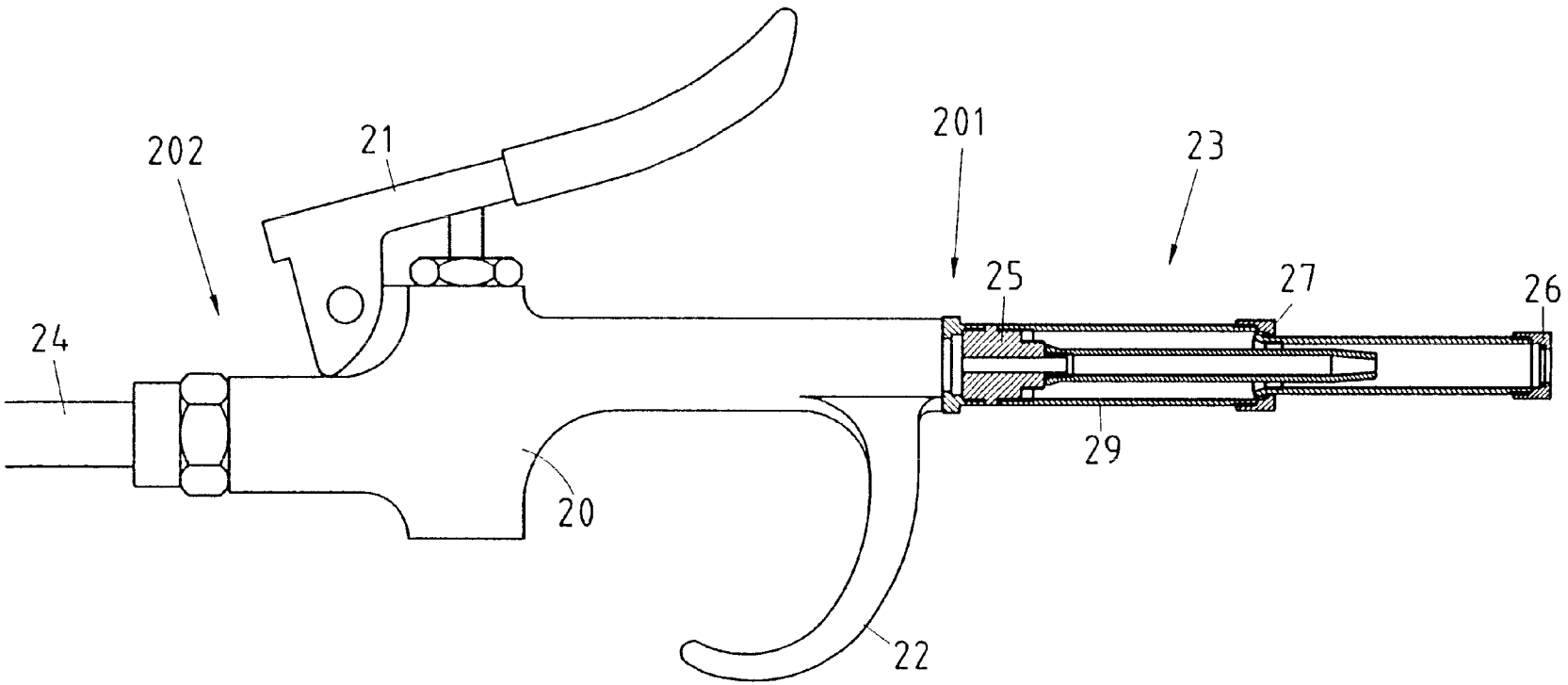

As shown in FIGS. 3–10, a pistol nozzle embodied in the present invention comprises a main body 20 and a telescopic barrel set 23.

The main body 20 is provided with a trigger 21, a retaining hook 22, a fluid emitting end 201, and a fluid admission end 202 which is fastened to a fluid pipe 24.

The pistol nozzle of the preferred embodiment of the present invention is characterized by the telescopic barrel set 23, which is fastened to the fluid emitting end 201 of the main body 20 and is formed of a fastening mount 25, a plurality of telescopic tubes 29, a plurality of stop members 26, and a plurality of washers 27.

The fastening mount 25 is provided at one end with outer threads, which are engaged with the inner threads of the fluid emitting end 201 of the main body. The fastening mount 25 is further provided at the opposite end with a stepped and threaded portion.

The telescopic tubes 29 are different in diameter from one another and are fastened at the base end thereof to the stepped and threaded portion of the fastening mount 25 at such time when the telescopic tubes 29 are collapsed together. The telescopic tubes 29 are provided at the base end with inner threads, and at the outer end with outer threads. When the telescopic tubes 29 are extended, they are fastened end to end such that the outer threads of the outer end of one telescopic tube 29 are engaged with the inner threads of the base end of another telescopic tube 29 in conjunction with a stop member 26 and a washer 27. The stop members 26 are intended to position the telescopic tubes 29 and are provided with inner threads engageable with the outer threads of the telescopic tubes 29. The washers 27 are intended to prevent the leaking of the compressed fluid.

Figure 9:
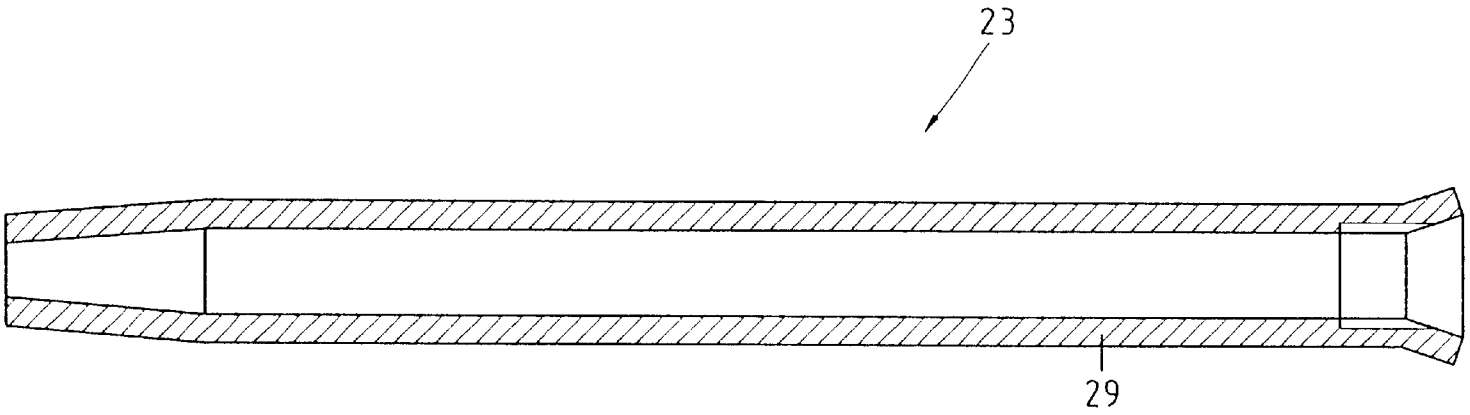
FIG. 9 shows a sectional view of the telescopic tube of the preferred embodiment of the present invention.
Figure 10:
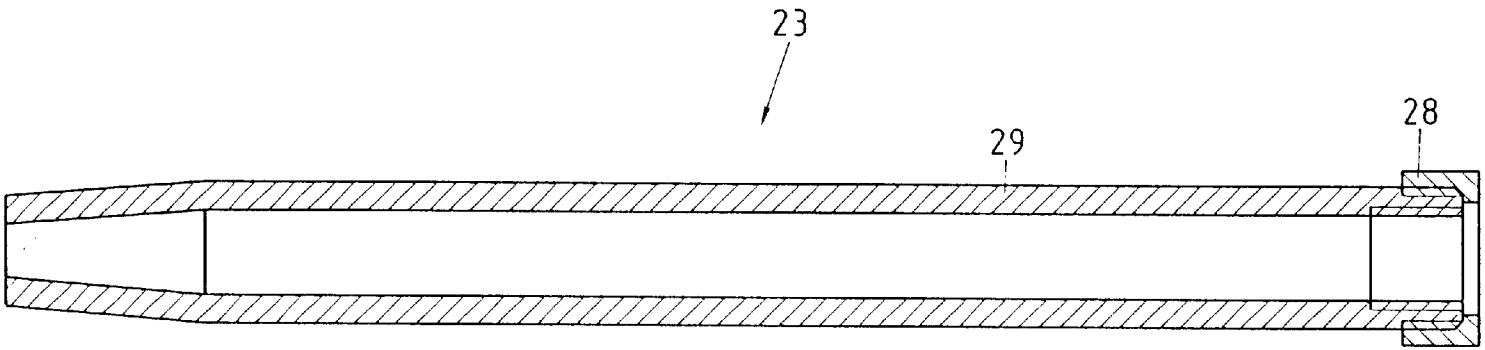
FIG. 10 shows another sectional view of the telescopic tube of the preferred embodiment of the present invention.

As shown in FIG. 9, the telescopic tube 29 is provided at an expansion end thereof with a stop sleeve 28 fitted thereover.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claims.

I claim:

1. A pistol nozzle apparatus comprising:

a main body having a fluid emitting end and a fluid admitting end, said main body having a retaining hook formed thereon, said main body having a trigger means cooperative therewith, said trigger means for controlling a rate at which a fluid passes outwardly of said fluid emitting end, said fluid admitting end connected to a fluid pipe, said fluid emitting end having inner threads formed interior thereof; and a telescopic barrel means fastened to said fluid emitting end of said main body, said telescopic barrel means for discharging the fluid therefrom, said telescopic barrel means comprising:

a fastening mount having outer threads at one end thereof said outer threads engaged with said inner threads of said fluid emitting end, said fastening mount having a stepped threaded portion at an opposite end thereof, said stepped threaded portion comprising a first externally threaded area, a second externally threaded area of greater diameter than a diameter of said first externally threaded area, and a third externally threaded area of greater diameter than the diameter of said second externally threaded area;

a first tube having a first end threadedly engageable with said first externally threaded area, said end of said first tube being of greater diameter than an opposite end of said first tube;

a second tube having a first end threadedly engageable with said second externally threaded area of said fastening mount, said first tube slidably mounted interior of said second tube, said second tube having a first stop member affixed to a second end thereof, said second tube having a washer sealingly interposed between said first stop member and an exterior surface of said first tube; and a third tube having a first end threadedly engaged with said third externally threaded area of said fastening mount, said second tube slidably mounted interior of said third tube, said third tube having a second stop member affixed to a second end thereof, said third tube having a washer sealing interposed between said second stop member and an exterior of said second tube.

2. The apparatus of claim 1, said second end of said second tube having exterior threads formed thereon, said second end of said third tube having exterior threads formed thereon, each of said first and second stop members having interior threads engaged with respective exterior threads of said second and third tubes.

* * * * *